US009280127B2

(12) United States Patent
Okamoto

(10) Patent No.: US 9,280,127 B2
(45) Date of Patent: Mar. 8, 2016

(54) IMAGE FORMING APPARATUS VENTING

(71) Applicant: BROTHER KOGYO KABUSHIKI KAISHA, Nagoya-shi, Aichi-ken (JP)

(72) Inventor: Yoshihiro Okamoto, Kasugai (JP)

(73) Assignee: BROTHER KOGYO KABUSHIKI KAISHA, Nagoya-Shi, Aichi-Ken ( * ) Notice: Subject to any disclaimer, the term of this patent is extended or adjusted under 35 U.S.C. 154(b) by 0 days.

(21) Appl. No.: 14/583,324

(22) Filed: Dec. 26, 2014

(65) Prior Publication Data

US 2015/0185684 A1 Jul. 2, 2015

(30) Foreign Application Priority Data

Dec. 27, 2013 (JP) ..... 2013-272853

(51) Int. Cl.
*G03G 21/20* (2006.01)
*G03G 21/16* (2006.01)

(52) U.S. Cl.
CPC ..... *G03G 21/1619* (2013.01); *G03G 21/206* (2013.01)

(58) Field of Classification Search
CPC ..... G03G 2221/1645; G03G 21/1619; G03G 21/206; G03G 21/20
USPC ..... 399/92
See application file for complete search history.

(56) References Cited

U.S. PATENT DOCUMENTS

2005/0074255 A1* 4/2005 Awaya ..... 399/92
2005/0232653 A1* 10/2005 Murooka ..... 399/92

FOREIGN PATENT DOCUMENTS

| | | |
|---|---|---|
| JP | 2000-211209 | 8/2000 |
| JP | 2011-095569 | 5/2011 |
| JP | 2012-237944 | 12/2012 |
| JP | 2013-003459 | 1/2013 |
| JP | 2013-210423 | 10/2013 |

* cited by examiner

*Primary Examiner* — Billy Lactaoen
(74) *Attorney, Agent, or Firm* — Merchant & Gould P.C.

(57) ABSTRACT

An image forming apparatus includes a main casing having side wall and a frame defining a sheet opening. The side wall of the main casing and the frame define an accommodating space therebetween. The frame defines a first vent, and the frame further defines a second vent disposed below the first vent closer to the side wall than the first vent.

17 Claims, 4 Drawing Sheets

IMAGE FORMING APPARATUS VENTING

CROSS-REFERENCE TO RELATED APPLICATION

This application claims priority from Japanese Patent Application No. 2013-272853 filed on Dec. 27, 2013, the content of which is incorporated herein by reference in its entirety.

FIELD OF DISCLOSURE

The disclosure relates to an electrophotographic image forming apparatus.

BACKGROUND

A known image forming apparatus includes a main body having a casing structure, an image forming unit accommodated in the main body, and a circuit board having electric elements mounted thereon and configured to supply electricity to the image forming unit.

The electric elements generate heat during the operation of the image forming apparatus. To prevent temperatures of the electric elements from rising, the electric elements need to be cooled.

Some known image forming apparatuses include a duct to cool a circuit board having electric elements mounted thereon. The duct is configured to discharge air heated by the electric elements of the circuit board outside the main body. Such ducts sometimes consume considerable space in the main body, requiring a larger main body and thus increasing the size of the image forming apparatus.

SUMMARY

According to aspects of the disclosure, an example image forming apparatus includes a main casing having side wall and a frame defining a sheet opening. The side wall of the main casing and the frame define an accommodating space therebetween. The frame defines a first vent, and the frame further defines a second vent disposed below the first vent closer to the side wall than the first vent.

DETAILED DESCRIPTION

1. Overall Configuration of Printer

Figure 1:
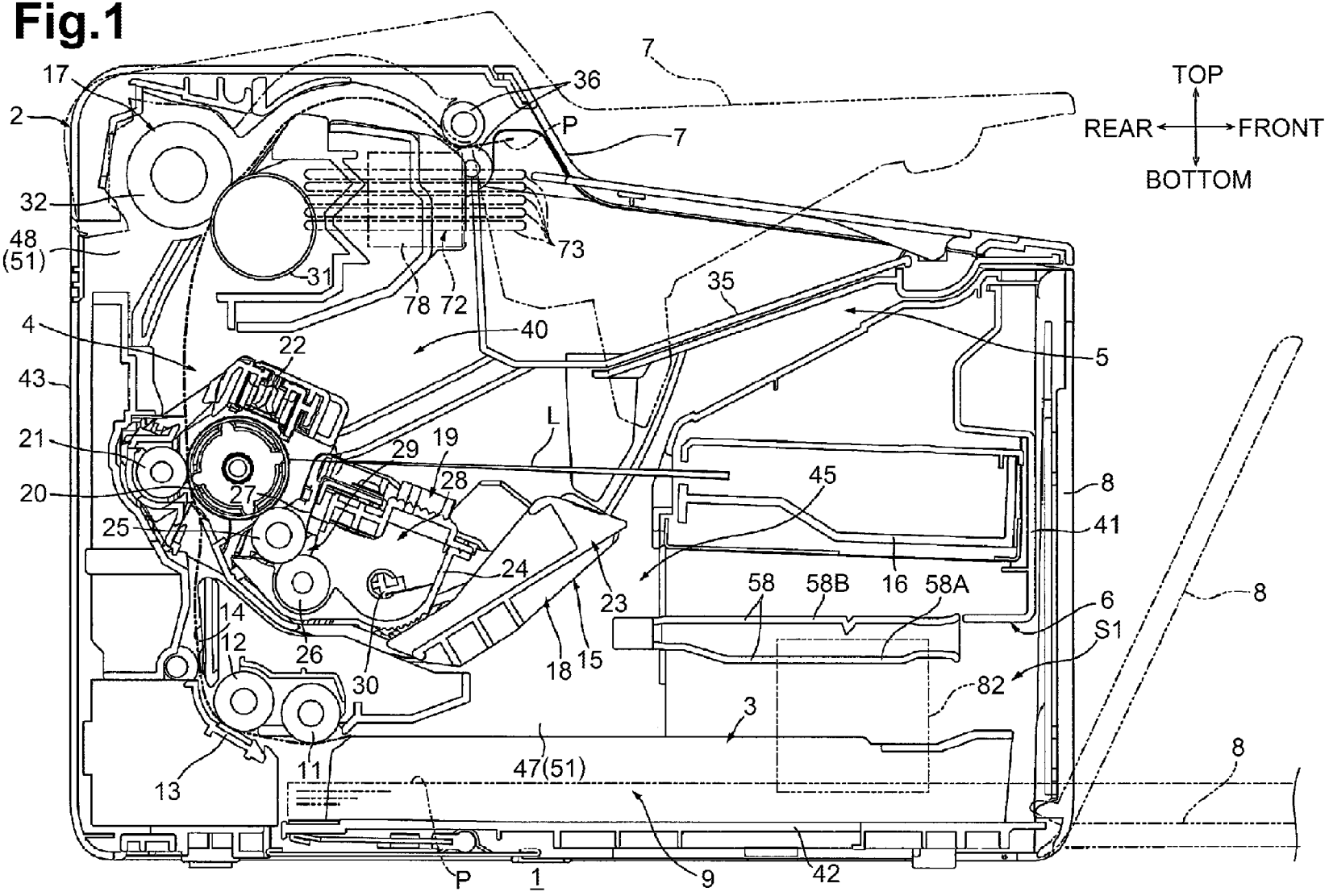
FIG. 1 is a cross-sectional view of a printer as an image forming apparatus in an illustrative embodiment according to one or more aspects of the disclosure.

As depicted in FIG. 1, an image forming apparatus, e.g., a printer 1, includes a casing, e.g., a main casing 2.

The main casing 2 has a generally box shape. The main casing 2 includes therein a sheet feed unit 3 configured to feed a recording medium, e.g., a sheet P, and an image forming unit 4 configured to form an image on the sheet P being fed.

In the following description, front, rear, left, right, top/upper, and bottom/lower sides of the printer 1 may be defined in conjunction with an orientation in which the printer 1 is placed in a horizontal plane. More specifically, left and right sides of FIG. 1 are defined as front and rear sides of the printer 1, respectively. Left and right sides when the printer 1 is viewed from the front side, e.g., front and back sides of the sheet of FIG. 1, are defined as left and right sides of the printer 1, respectively. Upper and lower sides of FIG. 1 are defined as top/upper and bottom/lower sides of the printer 1, respectively. In other words, the front-rear direction and the left-right direction are the horizontal direction. The top-bottom direction is the vertical direction. The left-right direction is an example of a direction perpendicular to the top-bottom direction or the vertical direction. A rightward side is an example of one side in the direction perpendicular to the vertical direction. A leftward side is an example of an opposite side in the direction perpendicular to the vertical direction.

(1) Main Casing

The main casing 2 has a cartridge opening portion 5, and an opening, e.g., a sheet opening portion 6.

The cartridge opening portion 5 is disposed at an upper end portion of the main casing 2. The cartridge opening portion 5 allows an interior and exterior of the main casing 2 to communicate with each other in the top-bottom direction. The cartridge opening portion 5 is shaped and sized to allow a process cartridge 15 (described below) to pass therethrough.

The sheet opening portion 6 is disposed at a front end portion of the main casing 2. The sheet opening portion 6 passes through a lower portion of the front end portion of the main casing 2 in the front-rear direction.

The main casing 2 includes a top cover 7 and a sheet feed cover 8.

The top cover 7 is disposed at an upper end portion of the main casing 2 to cover the cartridge opening portion 5 from above. The top cover 7 has a generally crank shape in side view and a generally rectangular shape in plan view.

The top cover 7 includes a discharge tray 35. The discharge tray 35 is formed as a recess by depressing a front portion of the top cover 7 downward. The discharge tray 35 has a generally U-shape in side view with an open end facing forward and upward.

The top cover 7 is configured to pivotally move about a rear end portion thereof between a closed position in which the cartridge opening portion 5 is closed and an open position in which the cartridge opening portion 5 is open.

Figure 2:
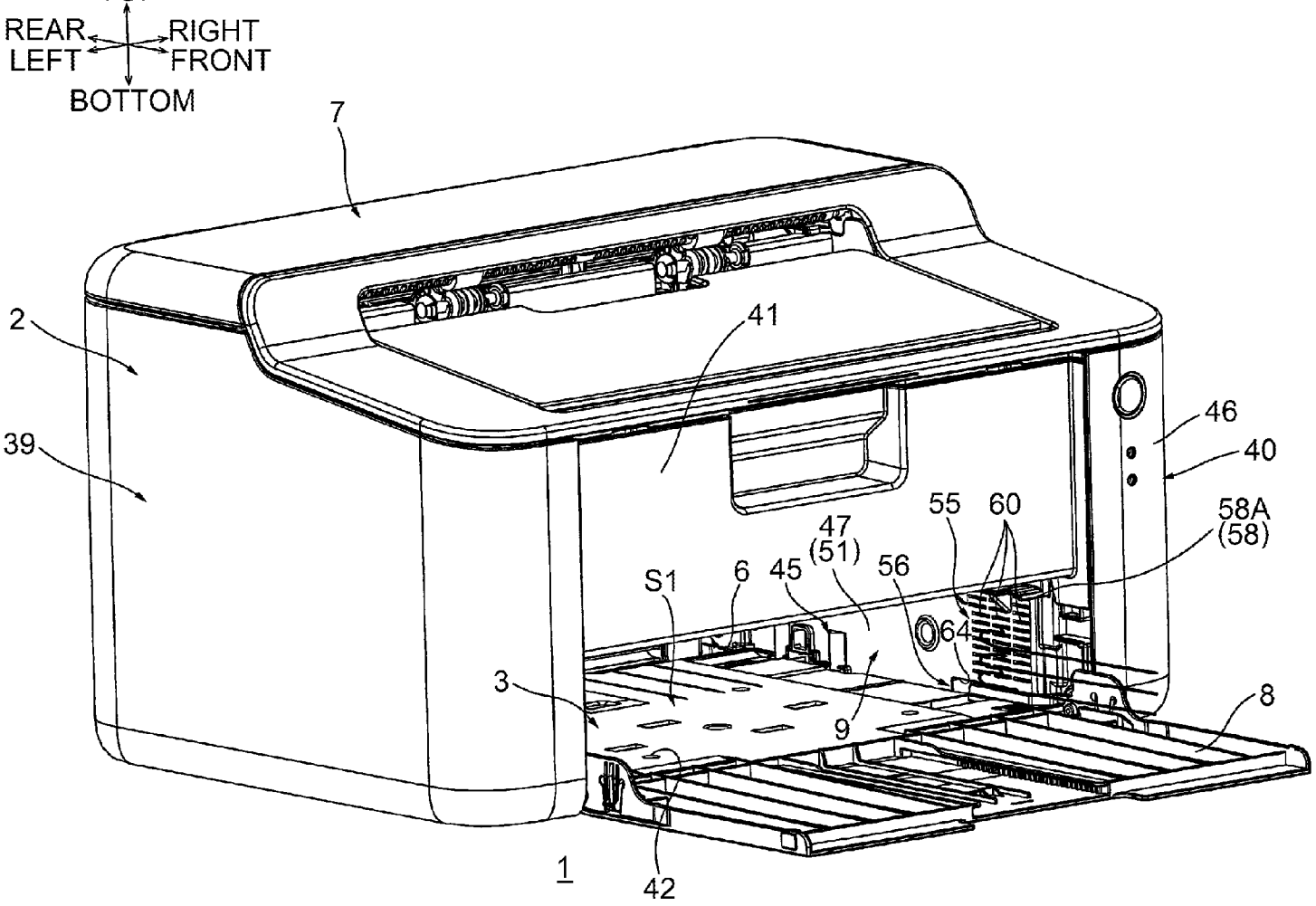
FIG. 2 is a perspective view of the printer depicted in FIG. 1 when the printer is viewed from the left front side.

The sheet feed cover 8 is disposed at a front end portion of the main casing 2 to cover the sheet opening portion 6 from the front. As depicted in FIG. 2, the sheet feed cover 8 is configured to pivotally move about a lower end portion thereof between a closed position in which the sheet opening portion 6 is closed and an open position in which the sheet opening portion 6 is open.

(2) Sheet Feed Unit

The sheet feed unit 3 is configured to feed the sheet P to the image forming unit 4. The sheet feed unit 3 is disposed at a bottom portion of the main casing 2.

The sheet feed unit 3 includes an accommodating portion, e.g., a sheet accommodating portion 9, a pickup roller 11, a feed roller 12, a feed pad 13, and a feed path 14.

As will be described in detail, the sheet accommodating portion 9 defines a sheet accommodating space S1 in which rear portions of the sheets P are accommodated. The sheet accommodating space S1 communicates with an exterior of the main casing 2 in the front-rear direction, via the sheet opening portion 6.

The pickup roller 11 is disposed above a rear portion of the sheet accommodating portion 9.

The feed roller 12 is disposed with a space behind the pickup roller 11. The feed pad 13 is disposed below and behind the feed roller 12 to contact a lower rear end portion of the feed roller 12. The feed path 14 extends upward continuously from a rear end portion of the feed pad 13.

(3) Image Forming Unit

The image forming unit 4 includes a process cartridge 15, a scanner unit 16, and a fixing unit 17.

The process cartridge 15 is configured to form a toner image on the sheet P. The process cartridge 15 is configured to be attached to or removed from the main casing 2, via the cartridge opening portion 5. The process cartridge 15 is configured to be attached to a rear portion of the main casing 2 at a generally central portion in the top-bottom direction. The process cartridge 15 includes a drum cartridge 18 and a developing cartridge 19.

The drum cartridge 18 includes a drum frame 23, a photosensitive drum 20, a transfer roller 21, and a scorotron charger 22.

The drum frame 23 has a bottomed rectangular frame shape. The photosensitive drum 20 has a generally tubular shape extending in the left-right direction. The photosensitive drum 20 is rotatably supported at a rear portion of the drum frame 23.

The transfer roller 21 has a generally cylindrical shape extending in the left-right direction. The transfer roller 21 is disposed behind the photosensitive drum 20. A front end portion of the transfer roller 21 is pressed against a rear end portion of the photosensitive drum 20. The transfer roller 21 is rotatably supported by the drum frame 23.

The scorotron charger 22 is disposed with a space in front of and above the photosensitive drum 20. The scorotron charger 22 is supported by the drum frame 23.

The developing cartridge 19 is configured to be attached to and removed from the drum frame 23. The developing cartridge 19 is disposed in front of and below the photosensitive drum 20 when the developing cartridge 19 is attached to the drum frame 23.

The developing cartridge 19 includes a developing frame 24, an agitator 30, a developing roller 25, a supply roller 26, and a layer thickness regulating blade 27.

The developing frame 24 has a generally box shape extending in the left-right direction. A rear end portion of the developing frame 24 is open toward the front-rear direction. The developing frame 24 includes therein a toner accommodating chamber 28 and a developing chamber 29 arranged along the front-rear direction. The toner accommodating chamber 28 accommodates developing agent, e.g., toner.

The agitator 30 is disposed at a generally central portion of the toner accommodating chamber 28 in the front-rear and top-bottom directions. The agitator 30 is rotatably supported by the developing frame 24.

The developing roller 25 is disposed at a rear end portion of the developing chamber 29. The developing roller 25 has a generally cylindrical shape extending in the left-right direction. The developing roller 25 is rotatably supported by the developing frame 24. An upper portion and a rear portion of the developing roller 25 are exposed from the developing frame 24. An upper rear end portion of the developing roller 25 contacts a lower front end portion of the photosensitive drum 20.

The supply roller 26 is disposed in the developing chamber 29, in front of and below the developing roller 25. The supply roller 26 has a generally cylindrical shape extending in the left-right direction. The supply roller 26 is rotatably supported by the developing frame 24. An upper rear end portion of the supply roller 26 contacts a lower front end portion of the developing roller 25.

The layer thickness regulating blade 27 is disposed in front of and above the developing roller 25. The layer thickness regulating blade 27 has a generally rectangular plate shape extending in the left-right direction in rear view. The layer thickness regulating blade 27 is supported by the developing frame 24 such that a lower end portion of the layer thickness regulating blade 27 contacts a front end portion of the developing roller 25.

The scanner unit 16 is disposed in a front portion of the main casing 2 at a generally central portion of in the top-bottom direction. The scanner unit 16 is disposed in front of the process cartridge 15 and above the sheet opening portion 6. As depicted in FIG. 1, the scanner unit 16 is configured to emit laser beam L toward the photosensitive drum 20 based on image data to expose the peripheral surface of the photosensitive drum 20.

The fixing unit 17 is disposed in the main casing 2 at an upper rear end portion thereof. The fixing unit 17 is disposed above a rear portion of the process cartridge 15. The fixing unit 17 is disposed to overlap with the process cartridge 15 and the feed roller 12 when viewed from the top-bottom direction.

The fixing unit 17 includes a heat roller 31 and a pressure roller 32. The pressure roller 32 is disposed behind and above the heat roller 31. A lower front end portion of the pressure roller 32 is pressed against an upper rear end portion of the heat roller 31.

(4) Sheet Accommodating Operation and Image Forming Operation

In the printer 1, a user may set one or more sheets P in the sheet accommodating portion 9 before an image forming operation.

To set the sheets P in the sheet accommodating portion 9, the sheet feed cover 8 is placed in the open position, to open the sheet opening portion 6 toward the front-rear direction.

The sheets P are introduced into the sheet accommodating portion 9 from the front to the rear, via the sheet opening portion 6. Thus, rear portions of the sheets P are accommodated in the sheet accommodating portion 9, and stacked on the upper surface of a bottom wall 42 of the main casing 2. Front portions of the sheets P are disposed outside the main casing 2 and stacked on the upper surface of the sheet feed cover 8 placed in the closed position.

Then, when an image forming operation is started under the control of a controller 77 (described below), the scorotron charger 22 uniformly charges a surface of the photosensitive drum 20. Thereafter, the scanner unit 16 exposes the surface of the photosensitive drum 20 with light. Thus, an electrostatic latent image based on image data is formed on the surface of the photosensitive drum 20.

The agitator 30 agitates the toner in the toner accommodating chamber 28. The agitator 30 supplies the agitated toner to the supply roller 26. The supply roller 26 supplies the toner supplied from the agitator 30 to the developing roller 25. At this time, the toner is positively charged by friction between the developing roller 25 and the supply roller 26 and is carried on the developing roller 25. The layer thickness regulating blade 27 regulates the thickness of the toner carried on the developing roller 25.

The developing roller 25 supplies the toner carried as a layer having a constant thickness to the electrostatic latent image on the surface of the photosensitive drum 20. Thus, a toner image is carried on the surface of the photosensitive drum 20.

The pickup roller 11 rotates to feed the sheets P accommodated in the sheet accommodating portion 9 toward a portion between the feed roller 12 and the feed pad 13. The feed roller 12 rotates to separate the sheets P fed between the feed roller 12 and the feed pad 13 one by one. Thereafter, the feed roller 12 rotates to feed the sheet P at a predetermined timing to the feed path 14 extending in the top-bottom direction. The sheet P is fed between the photosensitive drum 20 and the transfer roller 21.

Then, the transfer roller 21 transfers the toner image on the photosensitive drum 20 to the sheet P with transfer bias when the sheet P passes between the photosensitive drum 20 and the transfer roller 21.

Thereafter, the sheet P is fed between the heat roller 31 and the pressure roller 32. The heat roller 31 and the pressure roller 32 apply heat and pressure when the sheet P passes between the heat roller 31 and the pressure roller 32. At this time, the toner image on the sheet P is thermally fixed onto the sheet P. Thereafter, the sheet P is fed toward a pair of discharge rollers 36. A pair of the discharge rollers 36 discharge the sheet P onto the discharge tray 35 of the top cover 7.

Thus, the sheet P is fed along a generally C-shaped feed path in side view such that the sheet P fed from the sheet accommodating portion 9 passes between the photosensitive drum 20 and the transfer roller 21, and then between the heat roller 31 and the pressure roller 32 and finally discharged onto the discharge tray 35.

2. Details of Main Casing

As depicted in FIGS. 1 and 2, the main casing 2 includes a right side wall 40, a left side wall 39, a front wall 41, the bottom wall 42, and a rear wall 43.

Figure 3:
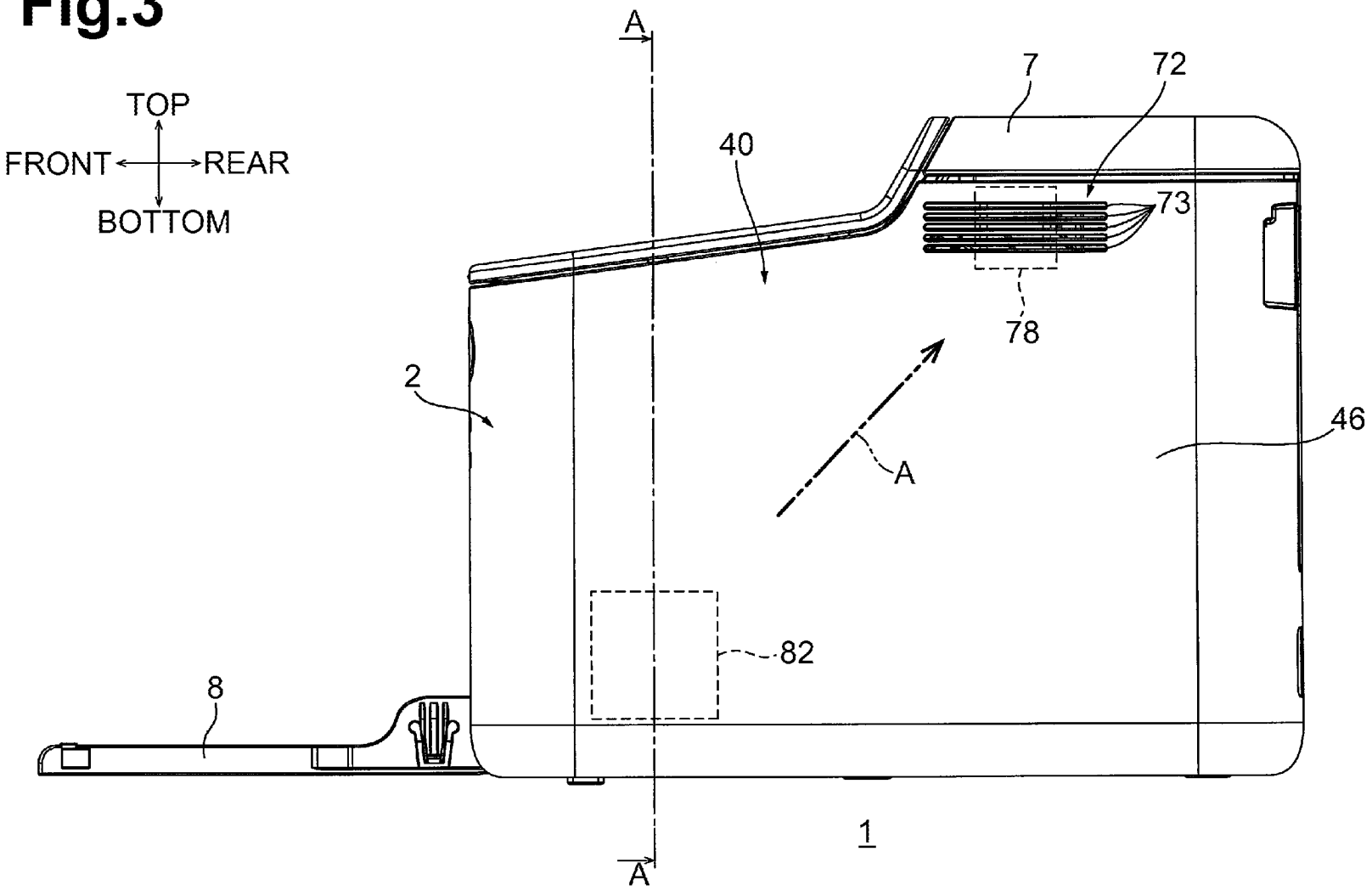
FIG. 3 is a right side view of the printer depicted in FIG. 1.
Figure 4:
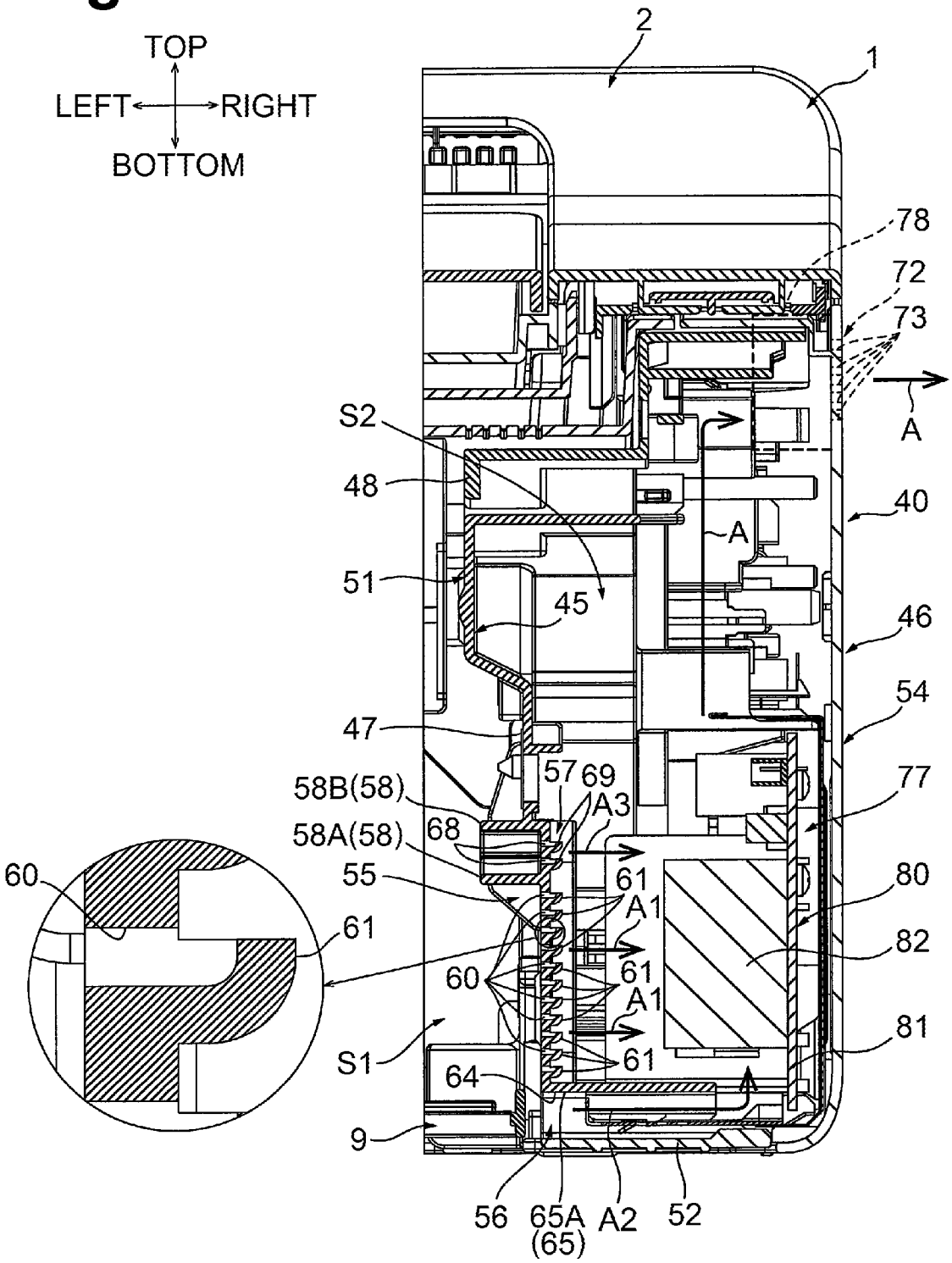
FIG. 4 is a cross sectional view of the printer taken along the line A-A of FIG. 3.

The right side wall 40 is a right end portion of the main casing 2. As depicted in FIG. 3, the right side wall 40 has a generally rectangular shape in side view. As depicted in FIG. 4, the right side wall 40 includes a frame, e.g., a main frame 45, and a cover, e.g., a side cover 46.

The main frame 45 is a left portion of the right side wall 40. The main frame 45 includes a known resin material. The main frame 45 is integrally provided with a plate 51, and a peripheral wall 52.

The plate 51 has a generally rectangular plate shape in side view. The plate 51 includes an upper portion 48 and a lower portion 47. The upper portion 48 is a portion of the plate 51 above the center of the plate 51 in the top-bottom direction. A rear portion of the upper portion 48 of the plate 51 is disposed adjacent to the fixing unit 17 to the right relative to the fixing unit 17. As depicted in FIG. 4, the lower portion 47 is a portion of the plate 51 below the center of the plate 51 in the top-bottom direction. As depicted in FIG. 1, the lower portion 47 is disposed the right of the sheet accommodating portion 9 configured to accommodate the sheets P therein.

The peripheral wall 52 protrudes to the right from all peripheral ends of the plate 51.

As depicted in FIGS. 2 and 4, the main frame 45 includes a first ventilating portion 55, a second ventilating portion 56, a third ventilating portion 57, and a pair of reinforcing ribs 58.

The first ventilating portion 55 corresponds to a power supply device 82 (described below). As depicted in FIG. 2, the first ventilating portion 55 is disposed at a front end portion of the lower portion 47 of the plate 51. As depicted in FIG. 4, the first ventilating portion 55 includes a plurality of first ventilating opening, e.g, a plurality of first opening portions 60, and a plurality of extending portions 61.

As depicted in FIG. 2, each of a plurality of the first opening portions 60 has a generally rectangular shape extending in the front-rear direction in side view. As depicted in FIG. 4, each first opening 60 passes through the lower portion 47 of the plate 51 in the left-right direction. A plurality of the first opening portions 60 is disposed in a generally grid pattern.

Each of a plurality of the extending portions 61 corresponds to the respective first opening portion 60. Each extending portion 61 is disposed on the right surface of the lower portion 47 of the plate 51. The extending portion 61 has a generally L shape in front view. The extending portion 61 extends to the right toward the low voltage power supply board 80 from the lower edge (e.g., the lower peripheral edge) of the corresponding first opening portions 60, and then curves upward. In other words, a right end portion of the extending portion 61 curves upward.

An upper end portion of the extending portion 61, e.g., the upper end of a right end portion of the extending portion 61, is positioned slightly lower than the upper edge of the corresponding first opening portion 60.

As depicted in FIG. 2, the second ventilating portion 56 is disposed in a front end portion of the lower portion 47 of the plate 51 with a space below the first ventilating portion 55. As depicted in FIG. 4, the second ventilating portion 56 includes a second ventilating opening, e.g, a second opening portion 64 and a duct portion 65.

As depicted in FIG. 2, the second opening portion 64 is disposed below a plurality of the first opening portions 60. The second opening portion 64 has a generally rectangular shape extending in the front-rear direction in side view. As depicted in FIG. 4, the second opening portion 64 passes through the lower portion 47 of the plate 51 in the left-right direction. An opening area of the second opening portion 64 is greater than an opening area of the first opening portion 60. The opening area of the second opening portion 64 is about six times as large as the opening area of the first opening portion 60.

The duct portion 65 corresponds to the second opening portion 64. The duct portion 65 is disposed at the right surface of the lower portion 47 of the plate 51. The duct portion 65 has a generally U shape in side view with an open end facing downward. The duct portion 65 extends to the right toward the side cover 46 continuously from the upper edge and each front and rear edge of the second opening portion 64 (e.g., an upper peripheral edge and each front and rear peripheral edges). In other words, an upper wall 65A of the duct portion 65 extends to the right continuously from the upper edge of the second opening portion 64 (e.g., the upper peripheral edge).

The dimension of the duct portion 65 in the left-right direction is greater than the dimension of the extending portions 61 in the left-right direction. A right end portion of the duct portion 65 is positioned more to the right than a right end portion of the extending portions 61. In other words, a right end portion of the second ventilating portion 56 is positioned more to the right than a right end portion of the first ventilating portion 55.

The third ventilating portion 57 is disposed at a front end portion of the lower portion 47 of the plate 51 with a space above the first ventilating portion 55. The third ventilating portion 57 includes a plurality of third ventilating opening, e.g, a plurality of third opening portions 68 and a plurality of extending portions 69.

Each of a plurality of the third opening portions 68 has generally the same shape and size as the first opening portion 60. Each third opening portion 68 passes through the lower portion 47 of the plate 51 in the left-right direction. A plurality of the third opening portions 68 is disposed in a grid pattern.

Each of a plurality of the extending portions 69 corresponds to the respective third opening portion 68. The extending portions 69 are disposed at the right surface of the lower portion 47 of the plate 51. Each extending portions 69 has generally the same shape and size as the extending portions 61 of the first ventilating portion 55. Each extending portions 69 extends to the right from the lower edge (e.g., the lower peripheral edge) of the corresponding third opening portion 68 and then curves upward.

A pair of the reinforcing ribs 58 is designed to reinforce the main frame 45. A pair of the reinforcing ribs 58 is disposed at the left surface of a front end portion of the lower portion 47 of the plate 51. A pair of the reinforcing rib 58 has a generally rectangular plate shape extending in the front-rear direction in plan view. The reinforcing ribs 58 face with each other with a space therebetween in the top-bottom direction.

More specifically, a pair of the reinforcing ribs 58 is disposed to interpose a plurality of the third opening portions 68 therebetween when viewed from the left-right direction. One reinforcing rib 58 is disposed above and below a plurality of the third opening portions 68. A pair of the reinforcing ribs 58 includes a reinforcing portion, e.g., a lower reinforcing rib 58A, and an upper reinforcing rib 58B.

The lower reinforcing rib 58A protrudes to the left from the left surface of a front end portion of the lower portion 47 of the plate 51 between a plurality of the first opening portions 60 and a plurality of the third opening portions 68 in the top-bottom direction. In other words, the lower reinforcing rib 58A is disposed above the first ventilating portion 55 and below the third ventilating portion 57.

The upper reinforcing rib 58B protrudes to the left from the left surface of a front end portion of the lower portion 47 of the plate 51 above a plurality of the third opening portions 68. In other words, the upper reinforcing rib 58B is disposed above the third ventilating portion 57.

The side cover 46 is a right portion of the right side wall 40. The side cover 46 constitutes an exterior of the right side wall 40. The side cover 46 covers the main frame 45 from the right. The side cover 46 is disposed with a space to the right relative to the plate 51 of the main frame 45 (e.g, the side cover 46 is disposed at an opposite side relative to the fixing unit 17). The side cover 46 includes a known resin material. As depicted in FIG. 3, the side cover 46 has a plate shape in side view having a generally the same shape and size as the main frame 45. Each of a front end portion and a rear end portion of the side cover 46 bends toward the left to cover a front end portion and a rear end portion of the main frame 45.

Thus, the right side wall 40, e.g., the main frame 45 and the side cover 46, constitutes an enclosure 54 defining an accommodating space S2 therein, as depicted in FIG. 4. In other words, the accommodating space S2 is defined between the plate 51 of the main frame 45 and the side cover 46 in the left-right direction.

As depicted in FIG. 3, the side cover 46 has a through opening 72. The through opening 72 is disposed at an upper rear end portion of the side cover 46. As depicted in FIG. 1, the through opening 72 is disposed in front of the heat roller 31 when viewed from the left-right direction. As depicted in FIG. 3, the through opening 72 has a plurality of slits 73. Each slit 73 has a generally linear shape extending in the front-rear direction in side view. Each slit 73 passes through the side cover 46 in the left-right direction. A plurality of the slits 73 is equidistantly arranged in the top-bottom direction. The through opening 72, e.g., a plurality of the slits 73, allows the accommodating space S2 in the enclosure 54 to fluidally communicate with an exterior of the main casing 2.

As depicted in FIG. 2, the left side wall 39 is a left end portion of the main casing 2. The side wall 39 is disposed with a space to the left relative to the right side wall 40. The left side wall 39 has a generally rectangular shape in side view. The image forming unit 4 is disposed between the left side wall 39 and the right side wall 40 in the left-right direction.

The front wall 41 is a front end portion of the main casing 2. The front wall 41 has a generally rectangular plate shape extending in the left-right direction in front view. The front wall 41 extends between a front end portion of an upper portion of the right side wall 40 and a front end portion of an upper portion of the left side wall 39.

The bottom wall 42 is a lower end portion of the main casing 2. The bottom wall 42 has a generally rectangular plate shape in bottom view. The bottom wall 42 extends between a lower end portion of the right side wall 40 and a lower end portion of the left side wall 39.

As depicted in FIG. 1, the rear wall 43 is a rear end portion of the main casing 2. The rear wall 43 has a generally rectangular plate shape in rear view. The rear wall 43 is disposed between a rear end portion of the right side wall 40 and a rear end portion of the left side wall 39.

As depicted in FIG. 2, the sheet opening portion 6 is defined by the lower end of the front wall 41, the front end of the lower portion 47 of the plate 51, the front end of a lower portion of the left side wall 39, and the front end of the bottom wall 42.

The sheet opening portion 6 has a generally a rectangular shape extending in the left-right direction in side view. A plane of the opening of the sheet opening portion 6 extends in the top-bottom direction and the left-right direction. The dimension of the sheet opening portion 6 in the left-right direction is longer than the dimension of the maximum size of the sheet P in the left-right direction that the printer 1 is able to print an image.

The sheet accommodating portion 9 is constituted by the lower portion 47 of the plate 51, a lower portion of the left side wall 39, the bottom wall 42, and a lower end portion of the rear wall 43. The sheet accommodating space S1 in the sheet accommodating portion 9 and an exterior space of the main casing 2 communicate with each other in the front-rear direction, via the sheet opening portion 6. The sheet accommodating space S1 in the sheet accommodating portion 9 and the accommodating space S2 in the enclosure 54 communicate with each other in the left-right direction via the first ventilating portion 55, the second ventilating portion 56 and the third ventilating portion 57.

3. Details of Controller

As depicted in FIG. 4, the printer 1 further includes the controller 77 and a fan 78.

The controller 77 and the fan 78 are disposed in the enclosure 54 of the right side wall 4, e.g., the accommodating space S2.

The controller 77 is configured to control operations of the image forming unit 4. The controller 77 includes a circuit board, e.g., a low voltage power supply board 80, and a control circuit board (not depicted).

The low voltage power supply board 80 is disposed to the right relative to the lower portion 47 of the plate 51. The low voltage power supply board 80 is fixed to the right surface of the plate 51. In other words, the low voltage power supply board 80 is disposed between the plate 51 of the main frame 45 and the side cover 46.

The low voltage power supply board 80 includes a board body 81, a heating element, e.g., a power supply device 82. The board body 81 has a generally rectangular plate shape extending the front-rear direction in side view. The board body 81 is disposed with a space to the right relative to the lower portion 47 of the plate 51 and with a space to the left relative to a lower portion of the side cover 46. The board body 81 is electrically connected to the scorotron charger 22, the transfer roller 21, the developing roller 25 and the supply roller 26, via wirings and electrodes (not depicted).

The power supply device 82 is attached to a front end portion of the left surface of the board body 81. The power supply device 82 is disposed with a space to the right relative to the first ventilating portion 55 of the lower portion 47 of the plate 51. In other words, the extending portions 61 of the first ventilating portion 55 extend from the lower edges of the corresponding first opening portions 60 toward the power supply device 82 of the low voltage power supply board 80.

More specifically, the power supply device 82 is disposed with a space to the right relative to the first ventilating portion 55 to overlap with the sheet accommodating portion 9 and the first ventilating portion 55 when viewed from the left-right direction. In other words, the power supply device 82 is disposed opposite to the first ventilating portion 55. The upper surface of the power supply device 82 overlaps with the third ventilating portion 57 when viewed from the left-right direction.

As depicted in FIG. 4, the power supply device 82 is disposed with a space to the upper right relative to the second ventilating portion 56. The power supply device 82 is disposed with a space above a right end portion of the duct portion 65 of the second ventilating portion 56, to overlap with the right end portion of the duct portion 65 when viewed from the top-bottom direction. As depicted in FIG. 1, the power supply device 82 is disposed in front of and below the fixing unit 17.

The control circuit board (not depicted) is electrically connected to the low voltage power supply board 80 via wirings. The control circuit board is configured to control the low voltage power supply board 80.

As depicted in FIGS. 3 and 4, the fan 78 is disposed at an upper rear portion of the enclosure 54. The fan 78 is disposed with a space to the rear and above relative to the power supply device 82.

More specifically, as depicted in FIG. 4, the fan 78 is attached to the left surface of an upper end portion of a rear portion of the side cover 46. The fan 78 is disposed adjacently to the left of the through opening 72. In other words, as depicted in FIG. 3, the fan 78 overlaps with the through opening 72 when viewed from the left-right direction. The through opening 72 is disposed behind and above the power supply device 82.

The fan 78 includes a rotating blade (not depicted). The fan 78 is configured to flow the air in the enclosure 54 toward the right as the rotating blade rotates. The fan 78 is electrically connected to the board body 81 via wirings (not depicted).

4. Cooling Operation

During the image forming operation, the fixing unit 17 thermally fixes onto the sheet P a toner image on the sheet P. Therefore, the fixing unit 17 generates heat and applies the heat to a rear end portion of the upper portion 48 of the plate 51 disposed adjacently to the right of the fixing unit 17. Accordingly, air in an upper rear portion of the enclosure 54 is heated via the upper portion 48 of the plate 51.

Thereafter, air in the upper rear portion of the enclosure 54 is discharged outside the enclosure 54 via a space between an upper end portion of the main frame 45 and an upper end portion of the side cover 46 or via the through opening 72.

Further, in the illustrative embodiment, the power supply device 82 supplies power to the fan 78 during an image forming operation, so that the fan 78 continuously rotates the rotating blade. Thus, air around the fan 78 in the enclosure 54 is discharged outside the enclosure 54, via the through opening 72.

Thus, as air in the enclosure 54 is discharged outside the enclosure 54, air in the enclosure 54 flows upward and rearward, as depicted by an arrow A in FIG. 3. Pressures in the enclosure 54 are reduced.

Thereafter, as depicted in FIG. 4, air in the sheet accommodating space S1 of the sheet accommodating portion 9 is taken into the enclosure 54, via the first ventilating portion 55, the second ventilating portion 56 and the third ventilating portion 57. Thus, pressures in the sheet accommodating portion 9 are reduced. Thereafter, air outside the main casing 2 is taken into the sheet accommodating portion 9 via the sheet opening portion 6, as depicted in FIG. 2. Then, the air is taken into the enclosure 54, via the first ventilating portion 55, the second ventilating portion 56 and the third ventilating portion 57.

Thus, as depicted in FIG. 4, air current A1 passing through the first ventilating portion 55, air current A2 passing through the second ventilating portion 56, and air current A3 passing through the third ventilating portion 57 occur.

The air current A1 passes through a plurality of the first opening portions 60 from the left to the right. Thereafter, the air current A1 reaches the left surface of the power supply device 82. Then, the flowing direction of the air current A1 is changed by the left surface of the power supply device 82. The air current A1 flows rearward and upward along the left surface of the power supply device 82.

After the air current A2 passes through the second opening portion 64 from the left to the right, the air current A2 is guided below the power supply device 82 by the duct portion 65. As the air current A2 rises, the air current A2 flows rearward and upward along the peripheral surface of the power supply device 82 after reaching the lower surface of the power supply device 82.

After the air current A3 passes through a plurality of the third opening portions 68 from the left to the right, the air current A3 reaches an upper end portion of the power supply device 82. The air current A3 flows to the right along the upper surface of the power supply device 82 and then flows upward and rearward.

During an image forming operation, the power supply device 82 of the low voltage power supply board 80 supplies power to the scorotron charger 22, the transfer roller 21, the developing roller 25 and the supply roller 26, and generates heat. However, the air current A1, the air current A2 and the air current A3 pass near the power supply device 82 as described above, so that the power supply device 82 may be efficiently cooled.

The air current A1, the air current A2 and the air current A3 join into air current A after the air current A1, the air current A2 and the air current A3 pass near the power supply device 82. The air current A flows upward and rearward from a portion near the power supply device 82 toward the through opening 72, as depicted in FIG. 3.

Thereafter, as the air current A reaches the fan 78 as depicted in FIG. 4, the flowing direction of the air current A is changed to the right by the driving of the fan 78. The air is discharged outside the printer 1, via the through opening 72.

Thus, a cooling operation for the power supply device 82 completes.

5. Effects (1) As depicted in FIG. 4, the first ventilating portion 55 is disposed to overlap with the power supply device 82 when viewed from the left-right direction. Therefore, after the air current A1 passing through the first ventilating portion 55 flows toward the power supply device 82 in the left-right direction, the air current A1 flows upward to pass near the power supply device 82.

The second ventilating portion 56 is disposed below the power supply device 82. A right end portion of the second ventilating portion 56 is positioned more to the right than a right end portion of the first ventilating portion 55. Therefore, the air current A2 passing through the second ventilating portion 56 flows upward from the underneath of the power supply device 82 to pass near the power supply device 82.

In other words, even with a simple structure, air flowing from an exterior of the main casing 2 via the sheet opening portion 6 flows toward the power supply device 82 in two direction, e.g., from the left and underneath of the power supply device 82, and reliably passes near the power supply device 82.

Therefore, the power supply device 82 may be efficiently cooled without separately providing a member to cool the power supply device 82. Consequently, in the illustrated device, while the number of components to be used in the printer 1 and the size of the printer 1 are reduced, the power supply device 82 may be efficiently cooled.

(2) As depicted in FIG. 4, the first ventilating portion 55 includes the extending portions 61 extending from the lower ends of the corresponding first opening portions 60 to the right toward the power supply device 82. Therefore, the air passing through the first opening portions 60 may be guided to the right, e.g., toward the power supply device 82.

(3) As depicted in FIG. 4, the second ventilating portion 56 disposed below the power supply device 82 includes the duct portion 65. The upper wall 65A of the duct portion 65 extends to the right from the upper end of the second opening portion 64 toward the side cover 46. Therefore, the air current A2 passing through the second opening portion 64 may be guided to reach a portion below the power supply device 82.

(4) As depicted in FIG. 4, a right end portion of the duct portion 65 is disposed below the power supply device 82 to overlap with the power supply device 82 when viewed from the top-bottom direction. Therefore, the air current A2 passing through the second opening portion 64 may reliably reach the underneath of the power supply device 82.

(5) As depicted in FIG. 4, a right end portion of the extending portion 61 curves upward. Therefore, entry of an end portion of the sheet P into the accommodating space S2 in the enclosure 54 via the first opening portions 60 may be prevented or reduced. Consequently, such situations may be prevented or reduced that an end portion of the sheet P gets caught in the first opening portions 60. Thus, the sheet P may be smoothly introduced to the sheet accommodating portion 9.

(6) As depicted in FIG. 4, an upper end portion of the extending portion 61 is positioned below the upper end of the corresponding first opening portion 60. Therefore, flow of air passing through the first opening portions 60 might not be prevented by the extending portions 61.

(7) As depicted in FIG. 4, the main frame 45 includes the lower reinforcing rib 58A. Therefore, rigidity of the main frame 45 may be reliably ensured even when the main frame 45 includes the first ventilating portion 55.

The main frame 45 includes the third ventilating portion 57 that is disposed above the lower reinforcing rib 58A. Therefore, the rate of flow of air from the sheet accommodating portion 9 into the accommodating space S2 of the enclosure 54 may be increased.

(8) The main frame 45 and the side cover 46 define the accommodating space S2 in which the low voltage power supply board 80 is accommodated, as depicted in FIG. 4. Therefore, in an image forming operation, the air current A directed from the lower front to the upper rear occurs in the accommodating space S2. Then, air outside the main casing 2 flows into the accommodating space S2, via the first ventilating portion 55 and the second ventilating portion 56, and the third ventilating portion 57.

Therefore, air outside the main casing 2 may reliably pass near the power supply device 82 of the low voltage power supply board 80. Consequently, the power supply device 82 may be reliably cooled.

(9) As depicted in FIGS. 3 and 4, the fan 78 is disposed in the accommodating space S2 above the power supply device 82. Therefore, as the fan 78 is driven, the air current A flowing from the lower front to the upper rear may reliably occur in the accommodating space S2.

Consequently, air outside the main casing 2 may reliably flow into the accommodating space S2 via the first ventilating portion 55 and the second ventilating portion 56, and the third ventilating portion 57. Therefore, the power supply device 82 may be more efficiently cooled.

(10) As depicted in FIG. 3, the side cover 46 includes the through opening 72 above the power supply device 82. Therefore, air passing near the power supply device 82 and warmed by the power supply device 82 may be discharged outside the accommodating space S2 via the through opening 72, as depicted in FIG. 4. Consequently, build-up of air warmed by the power supply device 82 into the accommodating space S2 may be prevented or reduced.

6. Modifications

While the disclosure has been described in detail with reference to the specific embodiment thereof, this is merely an example, and various changes, arrangements and modifications may be applied therein without departing from the spirit and scope of the disclosure.

For example, the printer 1 includes the fan 78 in the above-described illustrative embodiment. However, the disclosure is not limited thereto. For example, the printer 1 does not have to include the fan 78.

In such modification, the air current A directed from the lower front to the upper rear may occur in the enclosure 54, due to heat given off by the fixing unit 17. Therefore, air in the sheet accommodating portion 9 is taken into the enclosure 54, via the first ventilating portion 55, the second ventilating portion 56 and the third ventilating portion 57, as depicted in FIG. 4. Consequently, effects similar to those of the above-described illustrative embodiment may be obtained in the modification.

What is claimed is:

1. An image forming apparatus comprising:

a main casing having a side wall and a front wall extending perpendicularly to the side wall;

a frame including a plate oriented parallel to the side wall and defining a first accommodating space having a sheet opening through the front wall of the main casing;

the side wall of the main casing and the plate of the frame defining a second accommodating space therebetween;

the plate of the frame defining a first vent between the first accommodating space and second accommodating space;

the frame defining a second vent between the first accommodating space and second accommodating space, the second vent being disposed below the first vent and being closer to the side wall than the first vent;

a heat generating element disposed in the second accommodating space adjacent the side wall;

the first vent having a first vent opening through the plate of the frame and disposed opposite the heat generating element; and the second vent having an inlet open through the plate of the frame disposed below the first vent opening, and an outlet opening oriented perpendicularly to the inlet opening situated directly below the heat generating element.

2. The image forming apparatus of claim 1, further comprising:

a fixing unit configured to fix a developing agent image onto a sheet;

the heat generating element being disposed below the fixing unit in the second accommodating space.

3. The image forming apparatus of claim 1, wherein the first vent and the second vent are situated adjacent the sheet opening.

4. An image forming apparatus, comprising:

a main casing having a side wall and a front wall extending perpendicularly to the side wall;

a frame including a plate oriented parallel to the side wall and defining a first accommodating space having a sheet opening through the front wall of the main casing;

the side wall of the main casing and the plate of the frame defining a second accommodating space therebetween;

the plate of the frame defining a first rent between the first accommodating space and second accommodating space; and the frame defining a second vent between the first accommodating space and second accommodating space, the second vent being disposed below the first vent and being closer to the side wall than the first vent;

wherein the first vent comprises an extending portion extending from the frame adjacent a lower edge portion of the vent opening of the first vent into the second accommodating space toward the side wall, the extending portion having an end portion that curves upwardly.

5. The image forming apparatus according to claim 1, wherein the main casing includes a bottom wall, and wherein the second vent comprises a duct including an upper wall extending parallel to the bottom wall from the plate of the frame adjacent the inlet opening toward the side wall.

6. The image forming apparatus according to claim 5, wherein an end of the upper wall of the duct closer to the side wall is disposed under the heating element and vertically aligned with the heating element, and wherein the outlet opening of the second vent is defined between the end of the upper wall and the side wall.

7. The image forming apparatus according to claim 1, wherein the main casing includes a bottom wall, the first vent comprises an extending portion extending from the frame adjacent the first vent opening into the second accommodating space toward the side wall, the second vent comprises a duct including an upper wall extending parallel to the bottom wall from the plate of the frame adjacent the inlet opening toward the side wall, and an end of the upper wall of the duct closest to the side wall is disposed closer to the side wall than an end of the extending portion closest to the side wall.

8. The image forming apparatus according to claim 7, wherein the end of the extending portion closest to the side wall is bent upward.

9. The image forming apparatus according to claim 5, wherein the first vent opening defines an upper edge, and wherein an end portion of the extending portion closest to the side wall is disposed below the upper edge.

10. An image forming apparatus, comprising:

a main casing having a side a front wall extending perpendicularly to the side wall, and a bottom wall;

a frame including a plate oriented parallel to the side wall and defining a first accommodating space having a sheet opening through the front wall of the main casing;

the side wall of the main casing and the plate of the frame defining a second accommodating space therebetween;

the plate of the frame defining a first vent between the first accommodating space and second accommodating space;

the frame defining a second vent between the first accommodating space and second accommodating space, the second vent being disposed below the first vent and being closer to the side wall than the first vent;

a pair of reinforcing ribs that reinforce the frame, the reinforcing ribs disposed higher than first vent, each of the reinforcing ribs extending parallel to the bottom wall into the first accommodating space, and a third vent disposed between the pair of reinforcing ribs, the third vent having a third vent opening extending between the first and second accommodating spaces.

11. The image forming apparatus according to claim 1, further comprising a circuit board situated in the second accommodating space and extending parallel to the side wall, the heat generating element being mounted on the circuit board such that the heat generating element is between the circuit board and the first vent.

12. The image forming apparatus according to claim 10, wherein the side wall has a through hole disposed above the heating element to define an airflow path from the first, second and third vents, through the second accommodating space to the through hole.

13. The image forming apparatus according to claim 12, further comprising a fan disposed in the second accommodating space and disposed proximate the through hole.

14. An image forming apparatus comprising:

a main casing having a bottom wall, a front wall, a rear wall, and first and second side walls extending between the front wall and the back wall;

a frame including a plate oriented parallel to the side walls and defining a first accommodating space having a sheet opening through the front wall of the main casing;

the first side wall of the main casing and the plate of the frame defining a second accommodating space therebetween;

a heat generating element disposed in the second accommodating space, the heat generating element being mounted on a circuit board positioned parallel to and adjacent the first side wall;

the plate of the frame defining a first vent between the first accommodating space and second accommodating space, the first vent including a first vent opening through the plate to provide a first air flow path from the first accommodating space to the second accommodating space, the first vent being positioned closer to the front wall than the rear wall;

the plate of the frame defining a second vent between the first accommodating space and second accommodating space, the second vent having an inlet opening through the plate of the frame disposed below the first vent opening, and a duct with an upper wall extending parallel to the bottom wall from the plate into the second accommodating space to define an outlet opening oriented perpendicularly to the inlet opening situated directly below the heat generating element, the second vent being positioned closer to the front wall than the rear wall;

a through hole extending through the side wall disposed above the heat generating element to define an airflow path from the second accommodating space to an exterior of the main casing; and a fan disposed in the second accommodating space proximate the through hole to provide air flow from the first accommodating space, through the first and second vents to the second accommodating space, past the heat generating element, and through the through hole to the exterior of the main casing.

15. The image forming apparatus according to claim 14, further comprising:

a pair of reinforcing ribs that reinforce the frame, the reinforcing ribs disposed higher than first vent, each of the reinforcing ribs extending parallel to the bottom wall into the first accommodating space, and a third vent disposed between the pair of reinforcing ribs, the third vent having a third vent opening extending between the first and second accommodating spaces.

16. The image forming apparatus of claim 14, further comprising:

a fixing unit configured to fix a developing agent image onto a sheet;

the heat generating element being disposed below the fixing unit in the second accommodating space.

17. The image forming apparatus according to claim 14, wherein the first vent includes an end portion extending from the plate of the frame into the second accommodating space, and wherein the end portion is bent upward.

* * * * *